US007832849B2

(12) United States Patent
Ishizawa et al.

(10) Patent No.: US 7,832,849 B2
(45) Date of Patent: Nov. 16, 2010

(54) LIQUID CONTAINER

(75) Inventors: Taku Ishizawa, Matsumoto (JP); Satoshi Shinada, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 884 days.

(21) Appl. No.: 11/783,772

(22) Filed: Apr. 12, 2007

(65) Prior Publication Data

US 2007/0242117 A1 Oct. 18, 2007

(30) Foreign Application Priority Data

Apr. 12, 2006 (JP) ..... 2006-110207

(51) Int. Cl.
*B41J 2/175* (2006.01)
*B41J 2/14* (2006.01)

(52) U.S. Cl. ..... 347/86; 347/49

(58) Field of Classification Search ..... 347/19, 347/49, 85, 86, 87
See application file for complete search history.

(56) References Cited

U.S. PATENT DOCUMENTS 5,530,531 A * 6/1996 Girard ..... 399/120
5,734,401 A * 3/1998 Clark et al. ..... 347/86
6,017,118 A * 1/2000 Gasvoda et al. ..... 347/86
6,702,427 B2 3/2004 Shimizu et al.
6,722,762 B2 4/2004 Miyazawa et al.
6,749,294 B2 * 6/2004 Haldorsen ..... 347/87
6,955,422 B2 * 10/2005 Miyazawa et al. ..... 347/86
7,360,858 B2 * 4/2008 Hayamizu et al. ..... 347/19
2005/0024454 A1 2/2005 Hayamizu et al.

FOREIGN PATENT DOCUMENTS

JP 8-90788 A 4/1996
JP 11-170567 A 6/1999
JP 2001-113722 A 4/2001
JP 2002-234178 A 8/2002
JP 2003-34040 A 2/2003
JP 2003-341087 A 12/2003
JP 2005-22356 A 1/2005
WO WO 98/55325 A1 12/1998

* cited by examiner

*Primary Examiner*—Anh T. N. Vo
(74) *Attorney, Agent, or Firm*—Sughrue Mion, PLLC

(57) ABSTRACT

A liquid container that comprises a first member and a second member fixed to the first member and is detachably mounted on a liquid ejecting apparatus, wherein a first shape corresponding to a liquid capacity is integrally formed in the first member, a second shape corresponding to a liquid kind is integrally formed in the second member, and an erroneous insertion prevention mechanism for preventing an erroneous insertion into a container mounting portion includes the first shape and the second shape.

6 Claims, 9 Drawing Sheets

LIQUID CONTAINER

BACKGROUND

1. Technical Field

The present invention relates to a liquid container that has an erroneous insertion prevention mechanism for preventing an erroneous insertion into a container mounting portion of a liquid ejecting apparatus.

2. Related Art

In a color ink jet printer (liquid ejecting apparatus) that performs color printing, ink cartridges (liquid containers) as exclusive-use containers, in which ink of different colors of B (Black), C (Cyan), M (magenta), and Y (yellow) are filled, respectively, are used. Ink (liquid) filled in the individual ink cartridges are supplied to a print head that is driven in accordance with print data transmitted from a host computer and then is ejected at a target position on a printed matter, such as a paper or the like, through nozzle of the respective colors provided in the print head.

In recent years, in order to realize high-definition full color printing, color ink that is mounted on a printer includes intermediate colors of DY (dark yellow) or LC (light cyan), in addition to C (cyan), M (magenta), and Y (yellow). Then, the number of ink cartridges that are mounted on one printer has increased.

An exclusive-use cartridge mounting portion (container mounting portion) for each color is provided in the printer. However, when the ink cartridges having the same exterior size are used for the respective colors, the similar cartridge mounting portions are also arranged, and thus a user may mistake a mounting position. When an ink cartridge is mounted at an erroneous color position, ink around an ink supply port of the cartridge and ink of a different color remaining around an ink supply needle of the printer may be mixed with each other. Accordingly, print quality may be degraded.

Further, when plural kinds of ink cartridges that substantially have the same exterior and contain different kinds of ink (for example, dye or pigment) are manufactured, parts of a dye printer and a pigment printer can be shared. However, since the ink cartridges that substantially have the same shape and contain different kinds of ink are sold, an ink cartridge of an erroneous ink kind may be inserted into the printer. When a pigment ink cartridge is erroneously inserted into the dye printer, dye ink around an ink supply port of the ink cartridge and pigment ink remaining around an ink supply needle of the printer may be mixed with each other. Then, the pigment may be aggregated and clogging may occur in the head.

In addition, when plural kinds of ink cartridges that have substantially the same exterior and contain different filling amounts of ink are manufactured, in a printer that is expected to perform printing in small quantity, a cheap and small-capacity ink cartridge can be provided. Further, in a printer that is expected to perform printing in large quantity, a large-capacity ink cartridge can be provided with a low unit cost per 1 g of ink. However, since the ink cartridges that substantially have the same shape but different capacities are sold, an ink cartridge having an erroneous capacity may be inserted into the printer. If a small-capacity ink cartridge is inserted into a large-capacity printer, even if ink is exhausted, printing may be continuously performed, and thus the head may break down. To the contrary, when a large-capacity ink cartridge is inserted into a small-capacity printer, ink end may be judged in spite of the ink that remains still. Thus, a large quantity of ink may remain.

Accordingly, there has been suggested a technology that selectively provides identification projection portions (or recess portions) at a plurality of positions defined in a partial region of the carriage as an erroneous insertion prevention mechanism, which prevents an ink cartridge from being erroneously inserted into an unconformable different cartridge mounting portion (for example, see Patent Documents 1 to 5).

Patent Document 1: JP-A-2003-34040
Patent Document 2: JP-A-2002-234178
Patent Document 3: JP-A-11-170567
Patent Document 4: JP-A-2003-341087
Patent Document 5: JP-A-8-90788

As described above, the number of ink cartridges having similar shapes increases, and thus the erroneous insertion prevention mechanism needs to be structured to identify a larger number of kinds of ink cartridges.

Accordingly, when the shape corresponding to the ink capacity and the ink kinds is formed of one constituent part of the ink cartridge, the number of kinds of the parts is the number (the number of kinds of the ink capacity×the number of kinds of the ink) obtained by multiplying the number of kinds of the ink capacity by the number of kinds of the ink. Accordingly, the number of kinds of parts increases, thereby increasing the manufacture cost of a mold or the management cost of the parts.

SUMMARY

An object of the invention is to provide a liquid container that has an erroneous insertion prevention mechanism prepared for the plural kinds with the small number of parts.

The object of the invention is achieved by a liquid container liquid container that comprises a first member and a second member fixed to the first member and is detachably mounted on a liquid ejecting apparatus, wherein a first shape corresponding to a liquid capacity is integrally formed in the first member, a second shape corresponding to a liquid kind is integrally formed in the second member, and an erroneous insertion prevention mechanism for preventing an erroneous insertion into a container mounting portion includes the first shape and the second shape.

According to the liquid container with such a configuration, since the erroneous insertion prevention mechanism for preventing the erroneous insertion into the container mounting portion is configured by the first shape corresponding to the liquid capacity integrally formed in the first member and the second shape corresponding to the liquid kind integrally formed in the second member, the number of parts is suppressed to the sum of (the number of kinds of liquid capacities+the number of liquid kinds) of the number of kinds of the liquid capacities and the number of liquid kinds. Accordingly, it is possible to reduce the manufacture cost of the mold and the management cost of the parts.

In the liquid container with such a configuration, the first shape and the second shape may be provided on a first surface parallel to an insertion direction of the liquid container into the liquid ejecting apparatus.

According to the liquid container with such a configuration, since all of the first shape and the second shape are integrally disposed on the first surface that is one surface of the liquid container, it is possible to minimize and simplify the structure of the liquid container and further the structure of the erroneous insertion prevention shape in comparison with the case where these shapes are dispersedly disposed on the plural surfaces of the liquid container.

In the liquid container with such a configuration, a guide mechanism contact portion that is brought into contact with a guide mechanism provided in the container mounting portion for guiding the liquid container when the liquid container is mounted on the container mounting portion may be provided on a second surface of the container mounting portion adjacent to the first surface and parallel to the insertion direction into the liquid ejecting apparatus.

According to the liquid container with such a configuration, prior to detecting the erroneous insertion, since it is possible to guide the liquid container to any one of the container mounting portions by the erroneous insertion prevention mechanism, it is possible to reliably perform the erroneous insertion detection operation by the erroneous insertion prevention mechanism. That is, when the existence of the erroneous insertion prevention mechanism is assumed, the guide contact portion is not provided, and the insertion is performed in irregular posture, it is not easily recognize whether the erroneous posture insertion or the erroneous position insertion. Accordingly, the insertion may be interrupted in spite of the regular position insertion. With such a configuration of the invention, it is possible to prevent this situation.

In the liquid container with such a configuration, a mark corresponding to the liquid capacity may be integrally shaped on the first member.

According to the liquid container with such a configuration, the mark corresponding to the liquid capacity is shaped at the same time of shaping the first member. Thus, it is possible to omit the work of attaching the mark and reliably prevent erroneous display.

In addition, an assembling worker can also easily identify the liquid capacity, which is rarely grasped only with the shape of the erroneous insertion prevention mechanism, with the mark. Therefore, it is possible to reliably prevent erroneous assembly.

In the liquid container with such a configuration, a mark corresponding to the liquid kind is integrally shaped on the first member.

According to the liquid container with such a configuration, since the mark corresponding to the liquid kind is integrally shaped on the second member, the mark corresponding to the liquid kind is granted at the same time of assembling the liquid container. Thus, it is possible to omit the work of attaching the mark and reliably prevent the erroneous indication.

In addition, an assembling worker can also easily identify the liquid kind, which is rarely grasped only with the shape of the erroneous insertion prevention mechanism, through the mark. Therefore, it is possible to reliably prevent erroneous assembly.

In the liquid container with such a configuration, the first member may be a resin case having a substantially rectangular solid shape in which an opening is formed in one surface thereof, a liquid containing portion may be formed by sealing the opening with a film, and the second member may be a film protective member that covers the entire surface of the film.

According to the liquid container with such a configuration, since it is possible to reduce the number of parts by integrating the second member with the film protective member, it is easy to manage the parts and it is possible to reduce the number of assembly processes, thereby reducing the manufacture cost.

According to the liquid container according to the invention, since an erroneous insertion prevention mechanism for preventing an erroneous insertion into the container mounting portion is configured by the first shape corresponding to the liquid capacity integrally formed in the first member and the second shape corresponding to the liquid kind integrally formed in the second member, the number of parts is suppressed so as to be the number (kinds of liquid capacity+kinds of liquid) obtained by adding the number of kinds of the liquid capacity to the number of kinds of the liquid. Accordingly, it is possible to reduce the manufacture cost of the mold and the management cost of the parts.

Therefore, it is possible to provide a liquid container in which the erroneous insertion prevent mechanism can be formed with a small number of parts and a large number of completely incompatible patterns can be formed with easy design and simple structure in a small space, without enlarging and complicating the structure of the erroneous insertion prevention mechanism.

The present disclosure relates to the subject matter contained in Japanese patent application No. 2006-110207 filed on Apr. 12, 2006, which is expressly incorporated herein by reference in its entirety.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, exemplary embodiments of a liquid container according to the invention will be described in detail with reference to the accompanying drawings.

Figure 1:
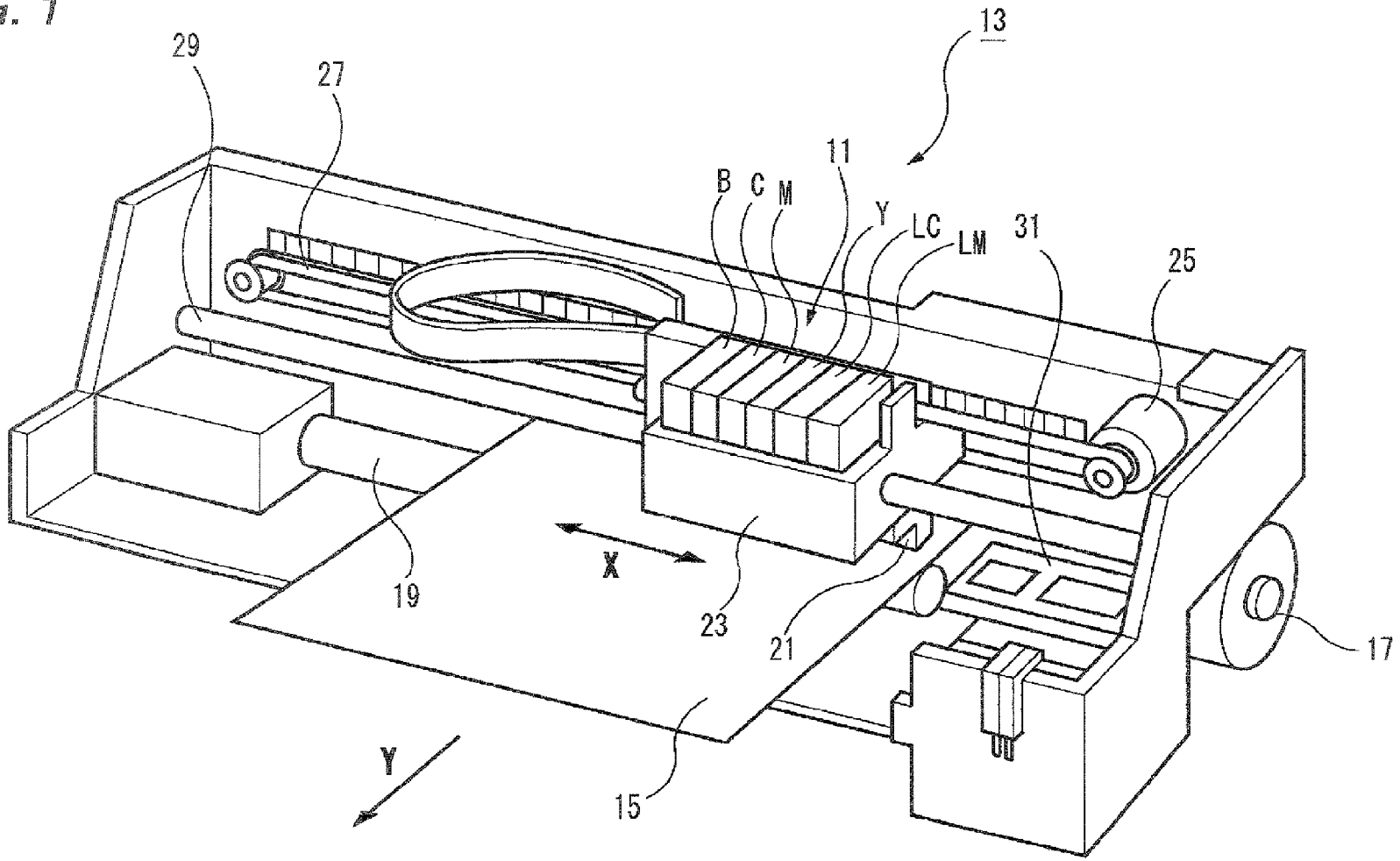
FIG. 1 is an exterior perspective view of a liquid ejecting apparatus on which a liquid container according to an embodiment of the invention is mounted.
Figure 2:
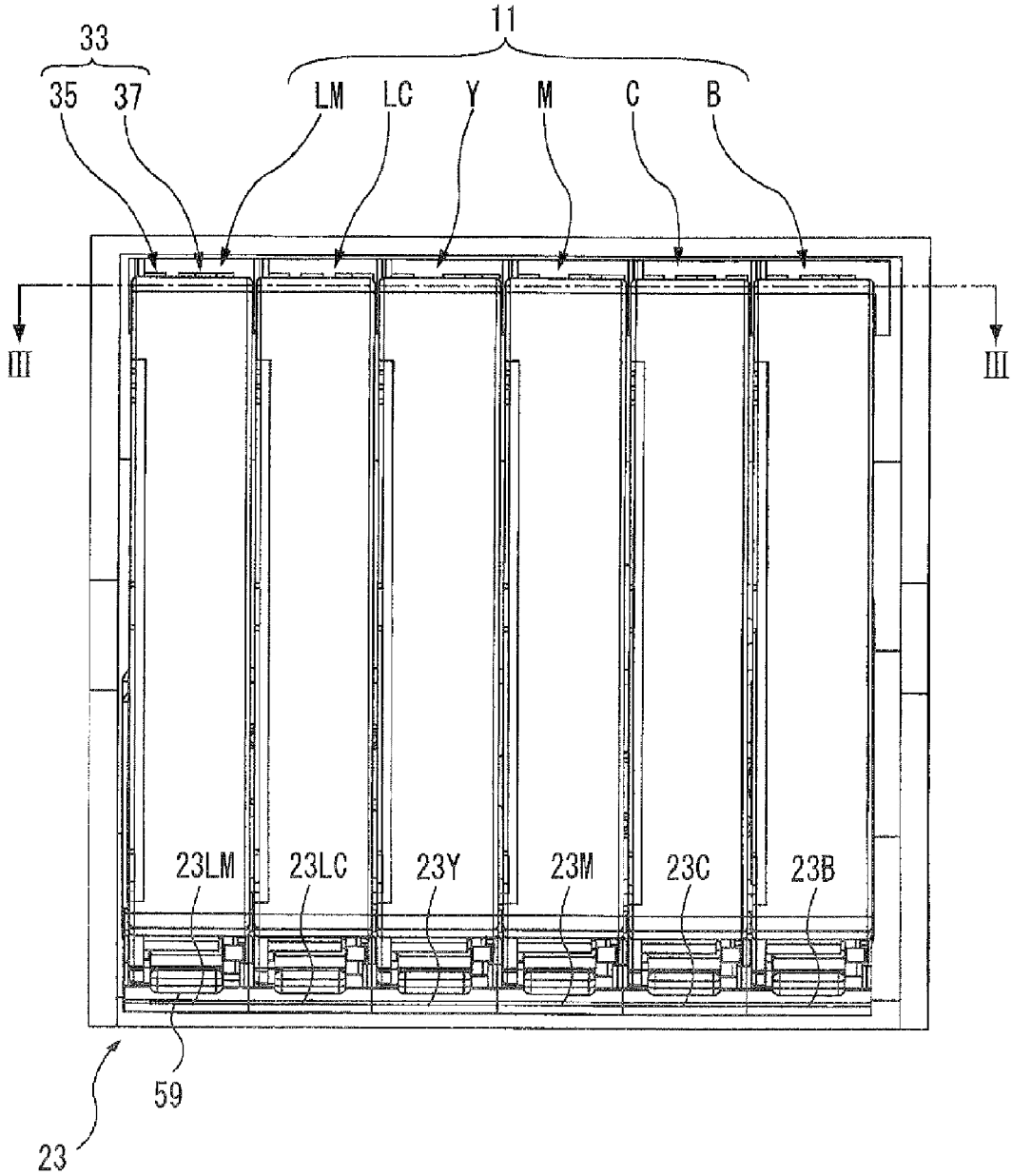
FIG. 2 is a plan view of a carriage shown in FIG. 1.
Figure 3:
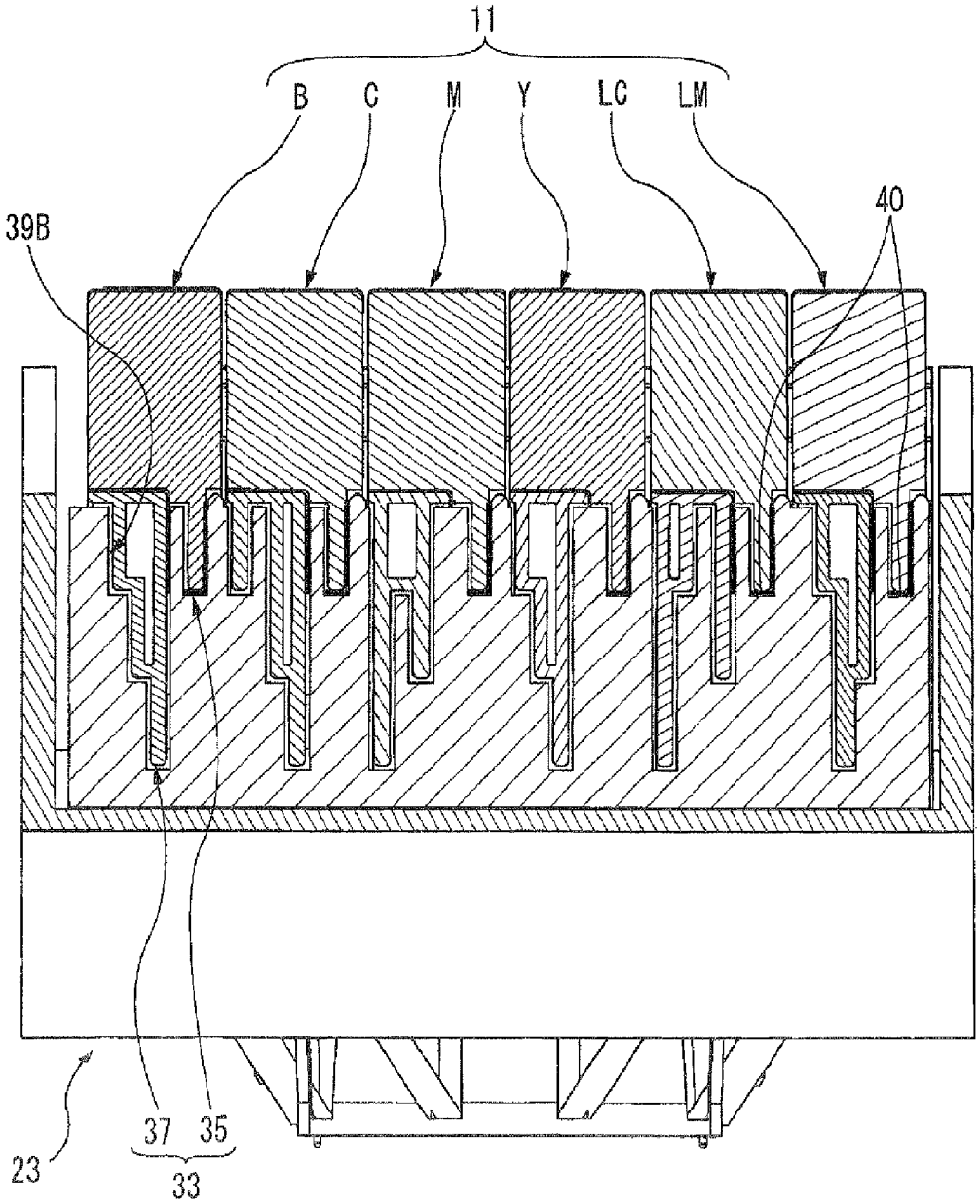
FIG. 3 is a cross-sectional view taken along the line III-III of FIG. 2.
Figure 4:
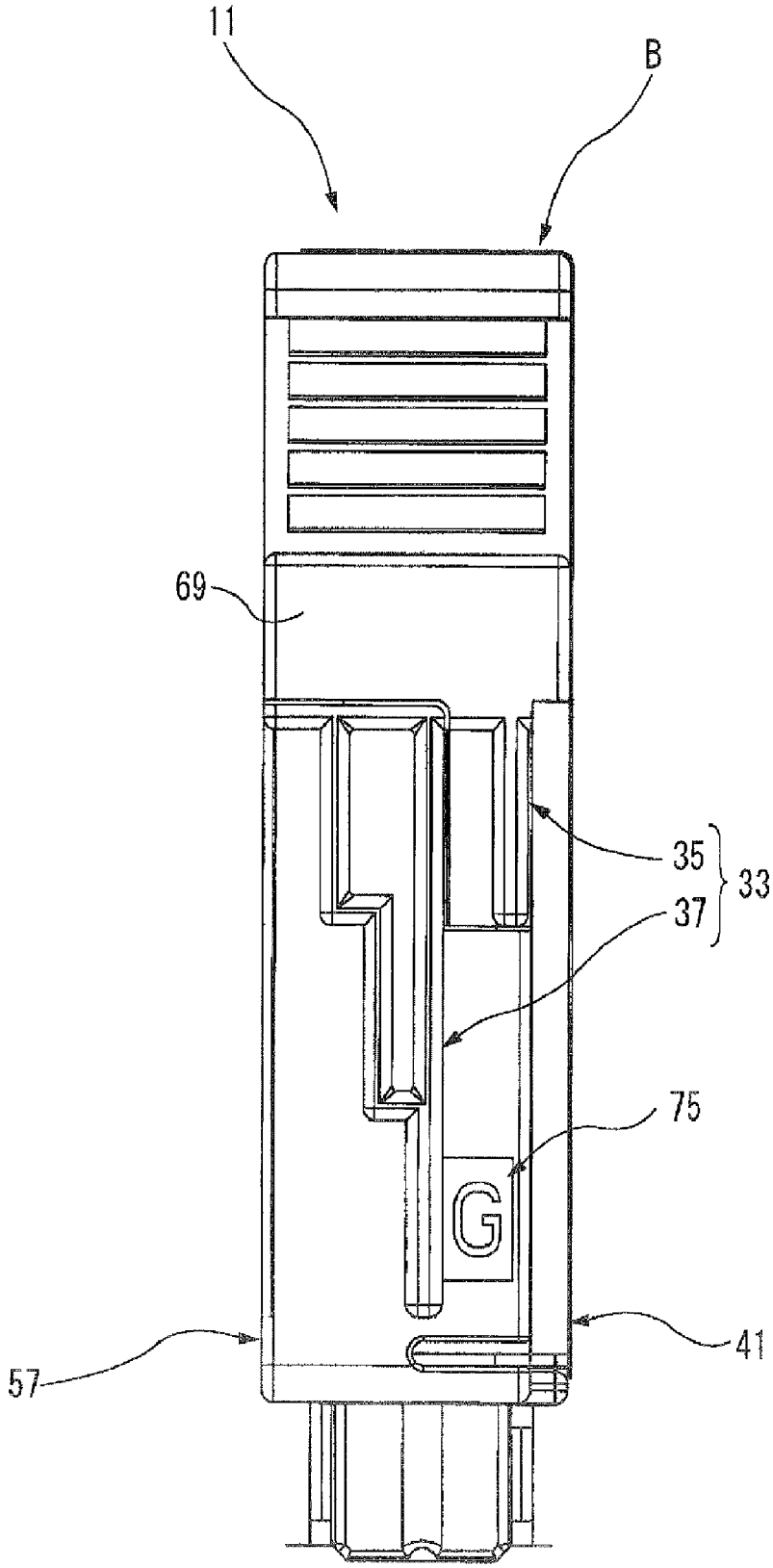
FIG. 4 is a rear view of an ink cartridge shown in FIG. 3.
Figure 5:
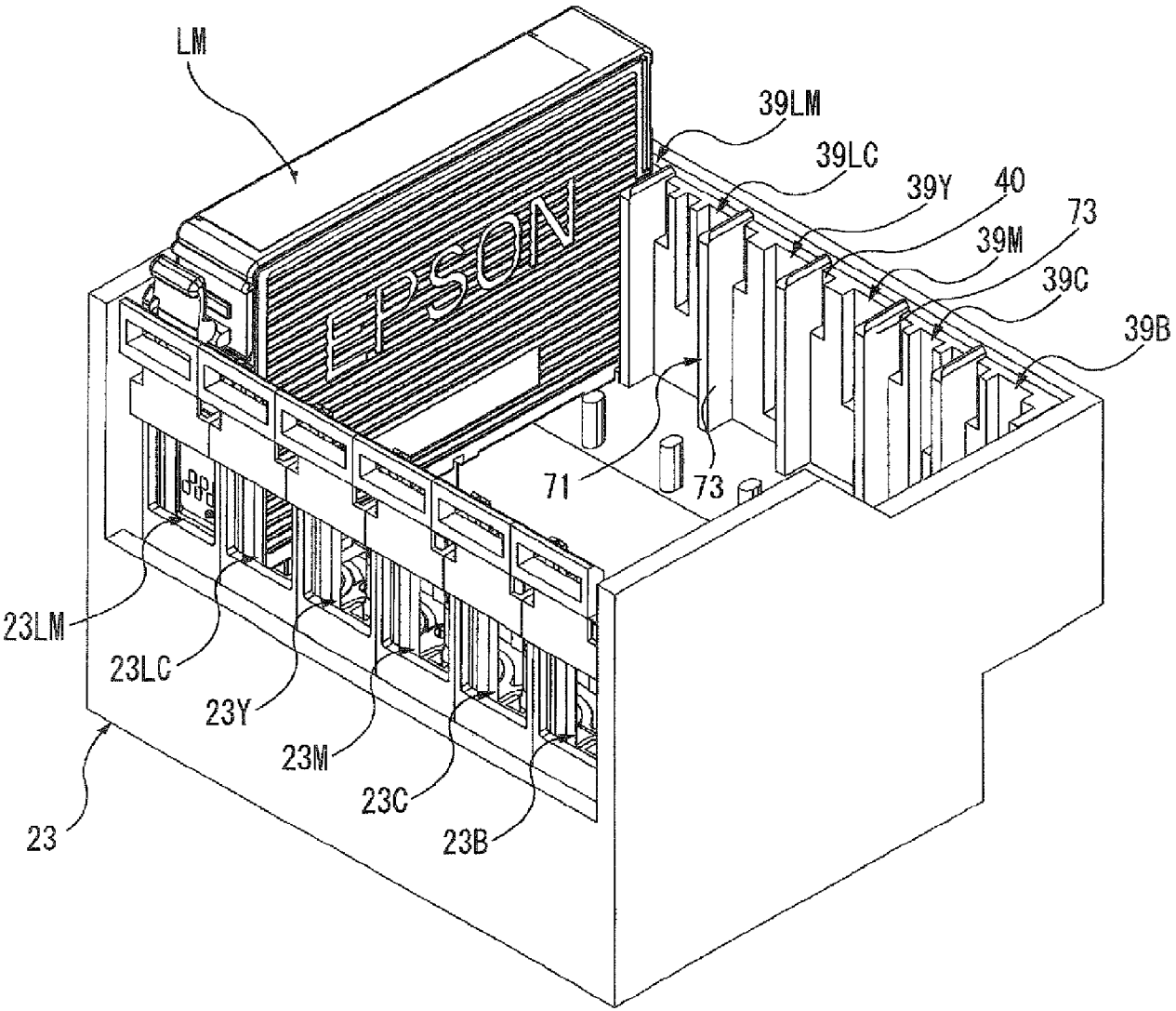
FIG. 5 is a perspective view showing a state where only one ink cartridge is mounted on a carriage shown in FIG. 1.

FIG. 1 is an exterior perspective view of a liquid ejecting apparatus on which a liquid container according to an embodiment of the invention is mounted. FIG. 2 is a plan view of a carriage shown in FIG. 1. FIG. 3 is a cross-sectional view taken along the line III-III of FIG. 2. FIG. 4 is a rear view of an ink cartridge shown in FIG. 3. FIG. 5 is a perspective view showing a state where only one ink cartridge is mounted on a carriage shown in FIG. 1.

A color ink jet printer (liquid ejecting apparatus) 13 on which ink cartridges (liquid containers) 11 according to this embodiment are mounted includes a paper feed motor 17 that feeds a recording paper 15 in a paper transport direction Y, a platen 19, a carriage 23 on which a print head (liquid ejecting head) 21 is mounted, and a carriage motor 25 that reciprocates the carriage 23 in a paper width direction X.

The carriage 23 is pulled by a pulling belt 27 that is driven by the carriage motor 25 and moves along a guide rail 29. On the carriage 23, an ink cartridge B for black as an ink cartridge, which contains black ink (liquid) supplied to the print head 21 and ink cartridges C, M, Y, LC, and LM for color as ink cartridges, which contain color ink (liquid) supplied to the print head 21, are mounted in addition to the print head 21.

As shown in FIGS. 2 and 3, in this embodiment, as the ink cartridges 11, the ink cartridges B, C, M, Y, LC, and LM are mounted on a plurality of cartridge mounting portions (container mounting portions) 23B, 23C, 23M, 23Y, 23LC, and 23LM, which are formed in the carriage 23.

An erroneous insertion prevention mechanism 33 is provided in each of the ink cartridges 11. The erroneous insertion prevention mechanisms 33 prevent the ink cartridges 11 from being erroneously inserted into the cartridge mounting portions 23B, 23C, 23M, 23Y, 23LC, and 23LM, respectively.

As shown in FIG. 4, in each of the ink cartridges 11 of this embodiment, the erroneous insertion prevention mechanism 33 has a conformation identification protrusion 35 that has a shape corresponding to an ink capacity and a conformation identification protrusion 37 that has a shape corresponding to the ink kind.

As shown in FIG. 5, the conformation identification protrusion 35 and the conformation identification protrusion 37 are fitted into the corresponding one of specified-shaped conformation grooves 39B, 39C, 39M, 39Y, 39LC, and 39LM that are formed at an internal rear wall of the carriage 23 to correspond to the ink cartridges B, C, M, Y, LC, and LM in the ink cartridges 11.

Figure 6B:
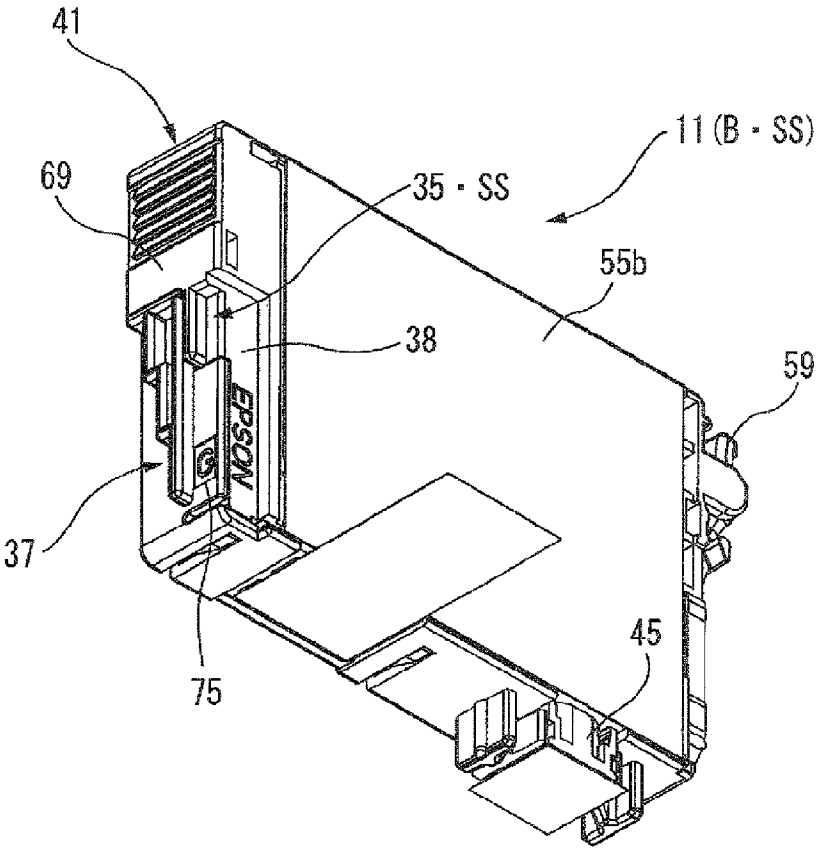
FIGS. 6A and 6B are perspective views of liquid containers having different capacities.
Figure 6A:
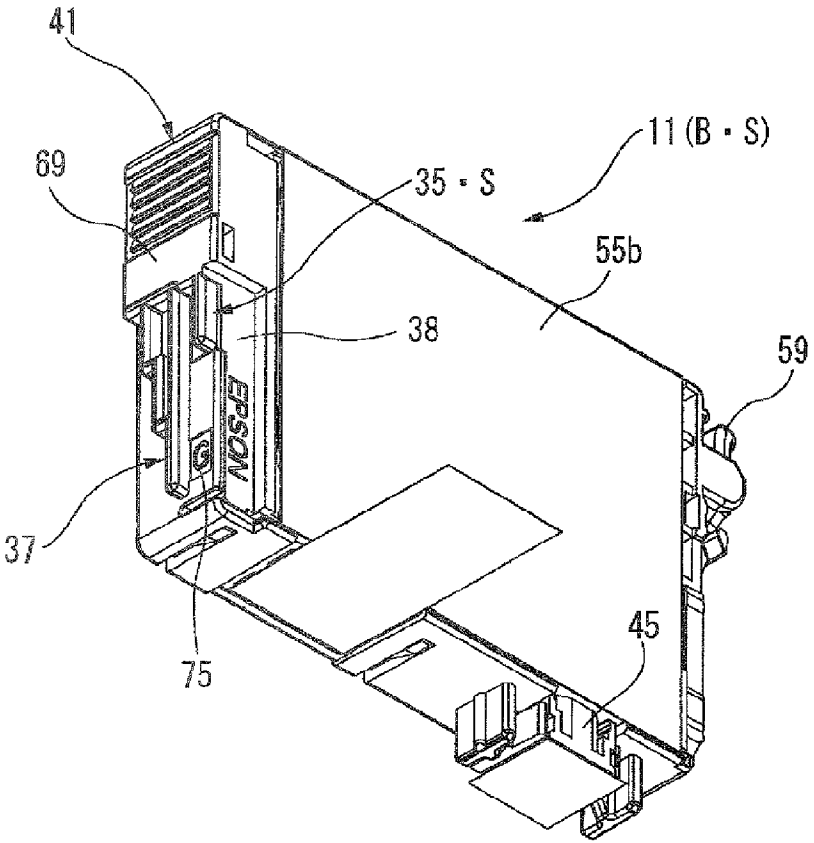

Meanwhile, the ink cartridges 11 may have the substantially same exterior but different ink capacities. As shown in FIG. 6, the ink cartridges B of the same color may be classified into, for example, an ink cartridge B·S with a large ink capacity and ink cartridge B·SS with a small ink capacity.

Herein, the schematic configuration of each of the ink cartridges 11 will be described.

Figure 7:
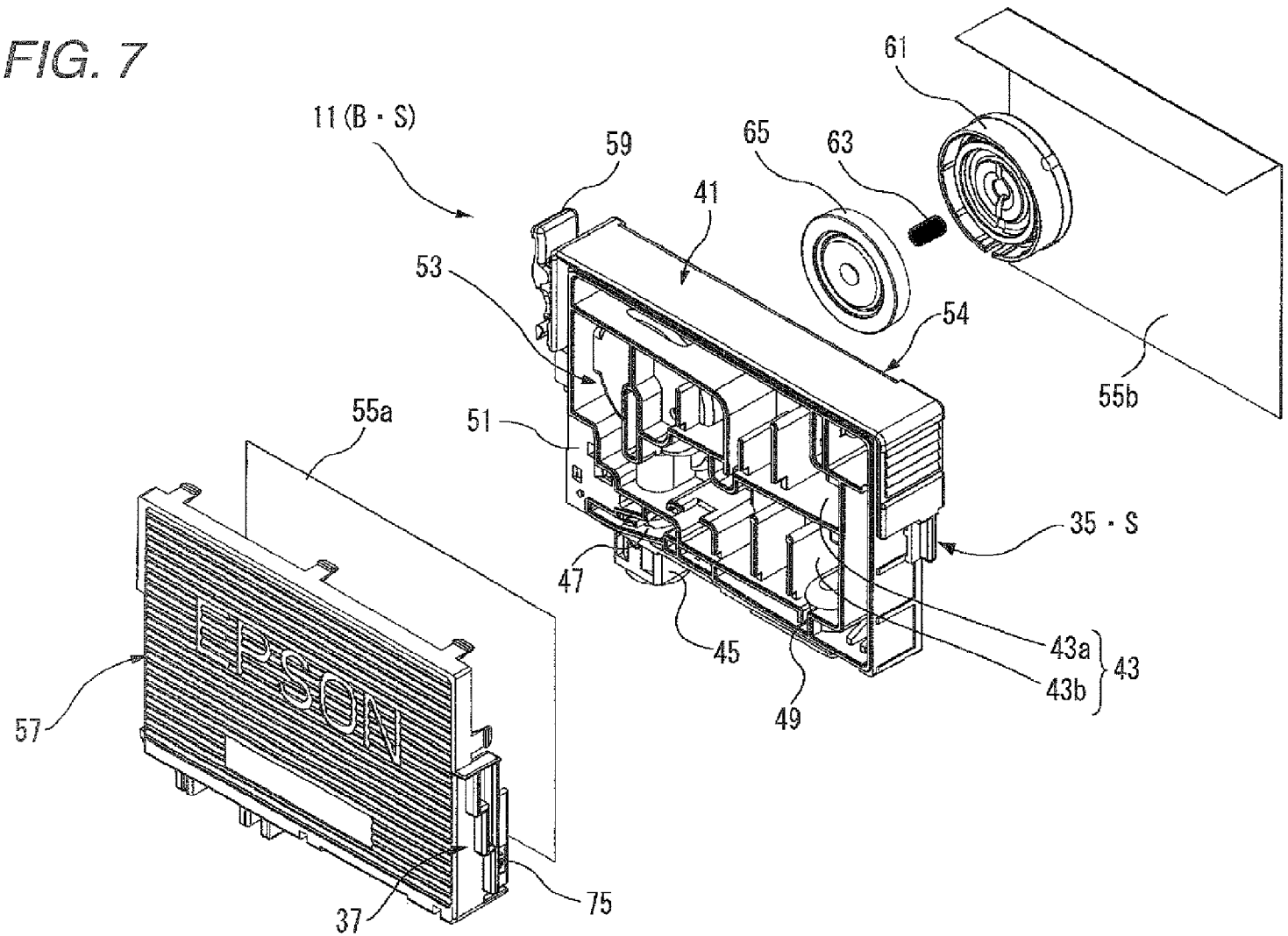
FIG. 7 is an exploded perspective view of a large-capacity liquid container.

As shown in FIG. 7, each of the ink cartridges 11 includes, in a container main body 41, a liquid containing portion 43 that has an upper storage portion 43*a* and a lower storage portion 43*b* for storing ink, an ink supply portion 45 that is connected to the print head 21, an ink guide path 47 that guides ink stored in the liquid containing portion 43 to the ink supply portion 45, and an atmosphere communicating port 49 that introduces atmosphere from the outside to the liquid containing portion 43 as ink in the liquid containing portion 43 is consumed.

In this embodiment, an ink end sensor 51 is provided at a position of the ink guide path 47 near the ink supply portion 45. The ink end sensor 51 detects an inflow of gas into the ink guide path 47 to detect that an ink residual quantity of the ink containing portion 43 becomes zero.

A film 55*a* is adhered onto an opening 53 of a front surface of the container main body 41, and a film 55*b* is adhered onto an opening 54 of a rear surface thereof. The films 55*a* and 55*b* close the openings 53 and 54 of the front and rear surfaces of the container main body 41 to form the liquid containing portion 43 and the ink guide path 47. Further, a cover member 57 is fixed to the front surface of the container main body 41 that is sealed with the film 55*a*.

Moreover, in the ink cartridges 11 of this embodiment, levers 59 are each provided to attach or detach the ink cartridges 11 to and from the cartridge mounting portions 23B, 23C, 23M, 23Y, 23LC, and 23LM on the carriage 23. Further, each of the ink cartridges 11 is provided with a pressure adjustment mechanism that includes a pressure-receiving plate accommodating portion 61, a coil spring 63, and a pressure-receiving plate 65.

Figure 8:
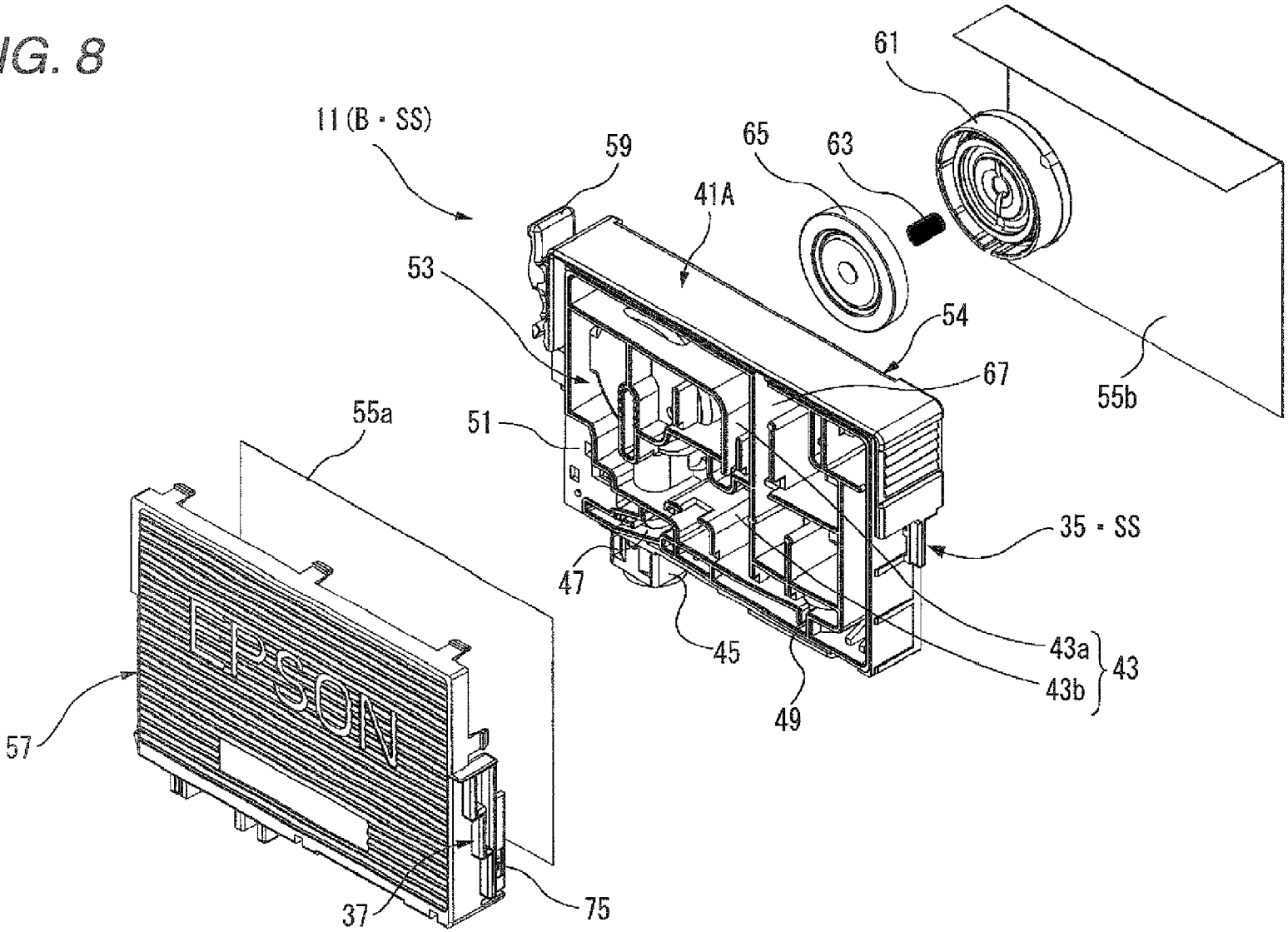
FIG. 8 is an exploded perspective view of a small-capacity liquid container.

In respect to the container main body 41 that is a first member for forming the liquid containing portion 43 of the ink cartridge 11, a container main body 41A, the volume of a tank portion of which varies according to an ink capacity, is generally used. That is, as shown in FIG. 8, in the container main body 41A that is used for the ink cartridge B·SS having a small ink capacity, parts of the upper storage portion 43*a* and the lower storage portion 43*b* are partitioned by a partition wall 67 so as to form a small-capacity ink cartridge.

The reason is as follows. When only 5 ml ink is filled into a container main body 41 into which 10 ml ink is to be filled, a large amount of air exists in the upper storage portion 43*a* and the lower storage portion 43*b*. Then, a large amount of air may be dissolved into ink due to vibration upon transportation. Accordingly, a degree of deaeration may be degraded, which may adversely affect printing reliability.

In each of the ink cartridges 11 of this embodiment, the conformation identification protrusion 35 that has a shape corresponding to an ink capacity is integrally formed in the container main body 41 as a first member. Further, the conformation identification protrusion 37 that has a shape corresponding to the ink kind is integrally formed in the cover member 57 as a second member.

As such, when the shape (conformation identification protrusion 35) corresponding to the ink capacity is integrally formed in a part forming the liquid container 43, the number of kinds of the cover member 57 as the second member may correspond to the number of colors. In this manner, when the shape corresponding to the ink capacity is provided in the container main body 41, and the shape corresponding to the ink kind is provided in the cover member 57, the number of kinds of parts is restricted to the sum of the number of kinds of ink capacities and the number of ink kinds (the number of kinds of ink capacities+the number of ink kinds). As a result, manufacturing costs of molds or management costs of parts can be reduced.

In this embodiment, as shown in FIG. 4, the conformation identification protrusion 35 and the conformation identification protrusion 37 are provided at a rear surface 69 as the first surface of each of the ink cartridges 11.

That is, the conformation identification protrusion 35 corresponding to the ink capacity and the conformation identification protrusion 37 corresponding to the ink kind are put together and arranged at the rear surface 69. Accordingly, the structures of the ink cartridges 11 themselves and the structures of the erroneous insertion prevention shapes (that is, the conformation grooves 39B, 39C, 39M, 39Y, 39LC, and 39LM) in the cartridge mounting portions 23B, 23C, 23M, 23Y, 23LC, and 23LM can be reduced in size and simplified, compared with a case where the shapes thereof are scattered at a plurality of surfaces of each of the ink cartridges 11.

In a partition wall 71 of each of the cartridge mounting portions 23B, 23C, 23M, 23Y, 23LC, and 23LM, as shown in FIG. 5, there is provided a guide mechanism 73 that guides a corresponding one of the ink cartridges 11 by being brought into contact with a recess (guide mechanism contact portion) 38 that is provided on the second surface adjacent to the rear surface 69 of the corresponding ink cartridge 11 and parallel to a direction that the ink cartridge 11 is inserted into the color ink jet printer.

Accordingly, prior to detecting an erroneous insertion by the erroneous insertion prevention mechanism 33, the corresponding ink cartridge 11 can be guided to one of the cartridge mounting portions 23B, 23C, 23M, 23Y, 23LC, and 23LM, and the erroneous insertion can be prevented over adjacent cartridge mounting portions 23B, 23C, 23M, 23Y, 23LC, and 23LM. Therefore, an erroneous insertion prevention operation by the erroneous insertion prevention mechanism 33 can be reliably exhibited.

That is, when the existence of the erroneous insertion prevention mechanism 33 is assumed, the guide contact portion 38 is not provided, and the insertion is performed in irregular posture, it is not easily recognized whether the erroneous posture insertion or the erroneous position insertion. Accordingly, the insertion may be interrupted in spite of the regular position insertion. With such a configuration of the guide mechanism contact portion 38 according to this embodiment, it is possible to prevent this situation.

At the rear surface 69 of each of the ink cartridges 11 according to this embodiment, a mark 75 corresponding to the ink kind is integrally shaped in the cover member 57.

Accordingly, when the mark 75 corresponding to the ink kind is granted simultaneously with assembling of each of the ink cartridges 11, a work that grants the mark 75 later can be omitted, thereby realizing work saving. In addition, erroneous display can be reliably prevented.

Further, an assembling worker can easily identify, through the mark 75, the ink kind that is rarely grasped only with the shape of the conformation identification protrusion 37 corresponding to the ink kind. Therefore, erroneous assembling can be reliably prevented.

Moreover, the mark corresponding to the ink capacity can also be integrally shaped in the container main body 41. In this case, the mark corresponding to the ink capacity depends on the structure of a resin case (container main body 41) as the first member, that is, the volume. Accordingly, when the mark corresponding to the ink capacity is granted by shaping simultaneously with shaping of the container main body 41, a work that grants a mark later can be omitted, thereby realizing work saving. In addition, erroneous display can be reliably prevented.

Further, an assembling worker can easily identify, through the mark 75, the ink capacity that is rarely grasped only with the shape corresponding to the ink capacity, that is, the shape of the conformation identification protrusion 35. Therefore, erroneous assembling can be reliably prevented.

Moreover, the container main body 41 is a resin case having a substantially rectangular solid shape. The opening 53 is sealed by the film 55*a*, thereby forming an ink storage chamber (liquid containing portion) 43. Further, the cover member 57 is a film protection member that covers the entire surface of the film 55*a*.

According to the ink cartridge 11 with such a configuration, the second member having the conformation identification protrusion 37 corresponding to the ink kind is integrated with the cover member 57, thereby reducing the number of parts. Accordingly, since the management of the parts becomes easy and the number of assembling processes can be reduced, the manufacture cost can be reduced. Of course, the second member having the conformation identification protrusion 37 may be separated from the cover member 57.

Figure 9:
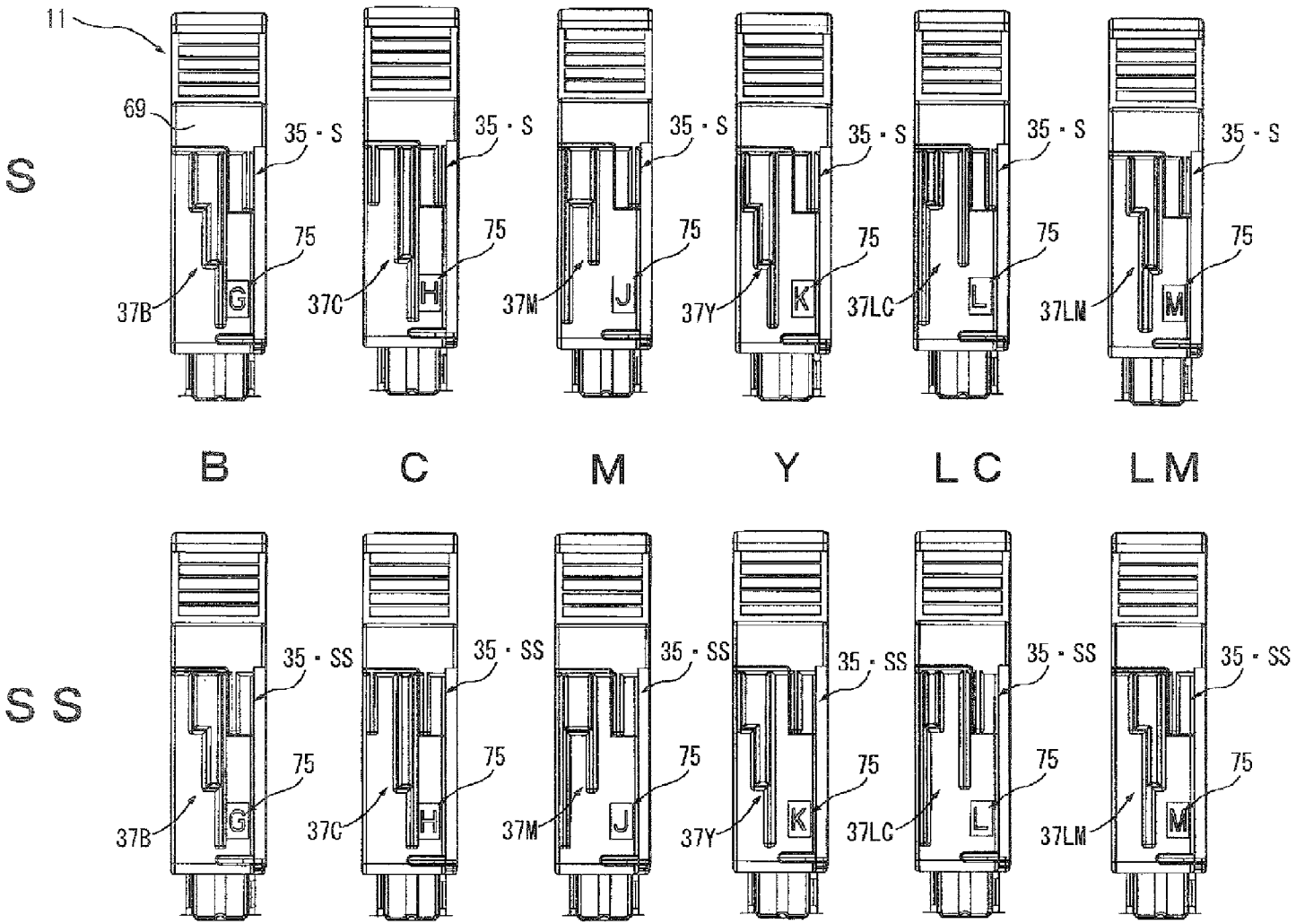
FIG. 9 is a rear view showing the erroneous insertion prevention mechanisms that are provided in the ink cartridges on the basis of capacities and colors.

FIG. 9 is a rear view of the ink cartridge 11 showing the erroneous insertion prevention mechanisms that are provided in the ink cartridges 11 on the basis of capacities and colors.

In the ink cartridges 11 of this embodiment, as shown in FIG. 9, a conformation identification protrusion 35 that has a shape corresponding to the ink capacity is provided in the container main body 41. Meanwhile, a conformation identification protrusion 37 that has a shape corresponding to the ink kind is provided in the cover member 57.

Accordingly, twelve kinds of ink cartridges 11 in total that are divided on the basis of two kinds ink capacities and six kinds of ink kinds can be manufactured by a small number of molds of two kinds of molds of the container main body 41 and six kinds of molds of the cover member 57.

According to the ink cartridge 11 of this embodiment, it is possible to reduce the manufacture cost of the mold and the management cost of the parts. Consequently, it is possible to form the erroneous insertion prevention mechanism 33 with a small number of parts, thereby reducing the manufacture cost of the ink cartridge 11.

In addition, the shape of the conformation identification protrusion 37 corresponding to the ink kind is integrally formed on the rear surface 69 of the cover member 57 that is a single member. Thus, the erroneous insertion is prevented by the difference in shape of the plural conformation identification protrusions 37.

According to the ink cartridge 11 of this embodiment, when the ink cartridge B and the ink cartridge Y are shifted by 1 pitch from each other, the conformation identification protrusions 37 thereof have the same shape. However, since the recess portion 38 (see FIG. 6) of the ink cartridge B is fitted to the guide mechanism 73 (see FIG. 5) of the cartridge mounting portion 23Y and then guided prior to identifying the erroneous insertion, the ink cartridge B can be prevented from being erroneously inserted into the cartridge mounting portion 23Y in a state where it is shifted by 1 pitch to the left.

Further, a capacity judgment groove 40 shown in FIGS. 3 and 5 has a shape corresponding to the S type ink cartridge 11 having a large ink capacity. Alternatively, a groove may be formed to have a shape corresponding to the SS type or both the S type and the SS type with simple configuration.

What is claimed is:

1. A liquid container detachably mounted on a container mounting portion of a liquid ejecting apparatus having a groove, the liquid container comprising:

a first member;

a second member fixed to the first member; and an erroneous insertion prevention mechanism configured to be fitted in the groove for preventing an erroneous insertion into the container mounting portion, the erroneous insertion prevention mechanism having:

a first protrusion corresponding to a liquid capacity integrally formed on the first member; and a second protrusion corresponding to a liquid kind integrally formed on the second member.

2. The liquid container according to claim 1, wherein the first protrusion and the second protrusion are provided on a first surface parallel to an insertion direction of the liquid container into the liquid ejecting apparatus.

3. The liquid container according to claim 2, further comprising:

a second surface being adjacent to the first surface and being parallel to the insertion direction of the container into the liquid ejection apparatus; and a guide mechanism contact portion on the second surface, the guide mechanism contact portion configured to be brought into contact with a guide mechanism provided in the container mounting portion for guiding the liquid container when the liquid container is mounted on the container mounting portion.

4. The liquid container according to claim 1, wherein a mark corresponding to the liquid capacity is integrally shaped on the first member.

5. The liquid container according to claim 1, wherein a mark corresponding to the liquid kind is integrally shaped on the first member.

6. The liquid container according to claim 1, wherein the first member is a resin case having a substantially rectangular solid shape in which an opening is formed in one surface thereof and a liquid containing portion is formed by sealing the opening with a film, and wherein the second member is a film protective member that covers the entire surface of the film.

* * * * *